US006924260B2

(12) United States Patent
Aubay

(10) Patent No.: US 6,924,260 B2
(45) Date of Patent: Aug. 2, 2005

(54) METHOD OF REDUCING AND PREVENTING SOIL REDEPOSITION IN AN AUTOMATIC DISHWASHING MACHINE

(75) Inventor: Eric Aubay, Princeton, NJ (US)

(73) Assignee: Rhodia Chimie, Boulogne Billancourt (FR)

( * ) Notice: Subject to any disclaimer, the term of this patent is extended or adjusted under 35 U.S.C. 154(b) by 0 days.

(21) Appl. No.: 10/445,591

(22) Filed: May 27, 2003

(65) Prior Publication Data

US 2003/0203825 A1 Oct. 30, 2003

Related U.S. Application Data

(63) Continuation-in-part of application No. 10/207,303, filed on Jul. 29, 2002, now Pat. No. 6,593,288, which is a continuation of application No. 09/596,586, filed on Jun. 19, 2000, now abandoned.

(30) Foreign Application Priority Data

Jul. 15, 1999 (FR) ..... 99 09183

(51) Int. Cl.[7] ..... C11D 1/66; C11D 3/37; C11D 3/39; C11D 3/395

(52) U.S. Cl. ..... 510/514; 510/223; 510/224; 510/226; 510/230; 510/372; 510/375; 510/376; 510/476; 510/504

(58) Field of Search ..... 510/223, 224, 510/226, 230, 372, 375, 376, 476, 504, 514; 134/25.2, 42

(56) References Cited

U.S. PATENT DOCUMENTS

| | | | | |
|---|---|---|---|---|
| 4,764,365 | A | 8/1988 | Boothe | 434/81 |
| 4,772,462 | A | 9/1988 | Boothe | 424/70 |
| 5,296,218 | A | 3/1994 | Chen | 424/70 |
| 5,981,456 | A | 11/1999 | Tartakovsky | 510/220 |
| 6,180,576 | B1 | 1/2001 | Melby | 510/121 |
| 6,281,180 | B1 | 8/2001 | Tartakovsky | 510/220 |
| 6,593,288 | B2 * | 7/2003 | Aubay et al. | 510/504 |

FOREIGN PATENT DOCUMENTS

| | | | |
|---|---|---|---|
| EP | 0 522 756 | 1/1993 | A61K/7/48 |
| EP | 0 835 925 | 4/1998 | C11D/3/37 |
| WO | WO 97/22640 | 6/1997 | C08F/220/28 |

* cited by examiner

*Primary Examiner*—Gregory R. Del Cotto

(57) ABSTRACT

This invention relates to the use of a water-soluble or water-dispersible copolymer comprising, in the form of polymerized units of at least one monomer compound bearing a quaternary ammonium (a) and at least one hydrophilic monomer (b) bearing a function of acidic nature which is copolymerizable with (a) and capable of ionizing in the application medium, the a/b molar ratio being between 50/50 and 10/90, in a method of reducing or preventing soil redeposition on kitchen- and tableware cleaned in an automatic dishwashing machine.

11 Claims, No Drawings

METHOD OF REDUCING AND PREVENTING SOIL REDEPOSITION IN AN AUTOMATIC DISHWASHING MACHINE

This application is a continuation-in-part of U.S. application Ser. No. 10/207,303, filed on Jul. 29, 2002 now U.S. Pat. No. 6,593,288, which is a continuation of U.S. application Ser. No. 09/596,586, filed on Jun. 19, 2000 now abandoned.

The invention relates to a method of reducing or preventing soil redeposition on kitchen- and tableware cleaned in an automatic dishwashing machine.

The invention relates more particularly to the use of polymers having both properties of interaction with the hard surface and hydrophilic properties to give this surface long-lasting hydrophilic properties so as to reduce or prevent soil redeposition on kitchen- and tableware cleaned in an automatic dishwashing machine.

EP 522 756 describes ampholytic terpolymers comprising, as polymer units:

- a cationic monomer, in particular dimethyldiallylammonium chloride (DADMAC for diallyldimethylammonium chloride);
- an anionic monomer, in particular acrylic acid;
- a nonionic monomer, in particular acrylamide.

These terpolymers have moisturizing and protective properties on the skin and the nails and are provided in compositions intended to be applied to the skin, such as aftershaves, sunscreens, hand lotions, liquid soaps, bath products and shaving foams. The document also describes a composition for doing the washing up by hand, this composition being particularly suitable for protecting and moisturizing the skin.

WO 97/22 640 describes aqueous dispersions of polymers with surfactant properties and more particularly foaming properties.

The polymers are prepared by polymerization of vinyl monomers (a) containing at least one quaternary nitrogen atom with vinyl monomers (b) containing at least one amide group and vinyl monomers (c) containing both hydrophilic and hydrophobic groups, so as to give the terpolymer detergent properties.

A monomer (a) which is mentioned in particular is DADMAC.

A monomer (b) which is mentioned in particular is (meth)acrylamide.

The monomers (c) are polyethoxylated and polypropoxylated derivatives of a carboxylic acid, such as acrylic acid.

EP 835 925 describes a detergent composition for doing the washing up in an automatic dishwasher, comprising a lipolytic enzyme and a copolymer obtained by polymerization of 50 mol % to 99 mol % of anionic monomer units, in particular of acrylic acid, with 1 mol % to 50 mol % of cationic monomers, in particular DADMAC and 0 mol % to 25 mol % of an anionic, cationic, amphoteric or nonionic monomer or a mixture thereof, in particular acrylic acid esters.

The combination of the lipolytic enzyme with the polymer avoids the deposition of calcium soap on the washing-up crockery without having harmful effect on the grease-removing action by the lipases.

It has been proposed (JP 09-169 995-A) to use, in compositions for treating toilet pans against soiling, a cationic polymer for increasing the hydrophilicity of the surface to be treated. Examples of cationic polymers which are mentioned are DADMAC homopolymers and copolymers of DADMAC and of acrylamide, as well as copolymers of DADMAC and of acrylic acid; the polymers mentioned as being preferred are the copolymers of DADMAC and of acrylic acid with a DADMAC/acrylic acid weight ratio of 8/2 and most preferably the DADMAC homopolymers.

The Applicant has found a method of reducing or preventing soil redeposition on kitchen- and tableware cleaned in an automatic dishwashing machine.

The studies by the inventors which have led to the present invention have determined that the copolymers obtained by copolymerization of monomers containing a quaternary ammonium function and two groups containing ethylenic unsaturation with monomers containing a group capable of ionizing in the application medium to form anionic units, with a ratio of the first monomers to the second monomers which is within a given range, are useful in a method of reducing or preventing soil redeposition on kitchen- and tableware cleaned in an automatic dishwashing machine.

The instant invention relates to a method of reducing or preventing soil redeposition on kitchen- and tableware cleaned in an automatic dishwashing machine, comprising the steps of:

1) providing a cleaning or rinsing composition having an effective amount of a water-soluble or water-dispersible copolymer; and
2) contacting said kitchen- and tableware with the composition in the wash or rinse cycle of an automatic dishwashing machine, wherein the water-soluble or water-dispersible copolymer reduces or prevents redeposition of soils on the kitchen- and tableware wherein the water-soluble or water-dispersible copolymer comprises, in the form of polymerized units:

(a) at least one monomer compound of general formula I:

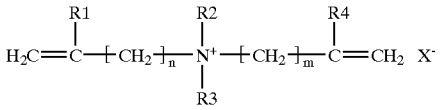

in which:

- $R_1$ and $R_4$, independently of each other, represent a hydrogen atom or a linear or branched $C_1$–$C_6$ alkyl group;
- $R_2$ and $R_3$, independently of each other, represent an alkyl, hydroxyalkyl or aminoalkyl group in which the alkyl group is a linear or branched $C_1$–$C_6$ chain, preferably a methyl group;
- n and m are integers between 1 and 3;
- X, which may be identical or different, represent counterions which are compatible with the water-soluble or water-dispersible nature of the polymer;

(b) at least one hydrophilic monomer bearing a function of acidic nature which is copolymerizable with (a) and capable of ionizing in the application medium, (c) optionally, at least one hydrophilic monomer compound containing ethylenic unsaturation and of neutral charge, bearing one or more hydrophilic groups, which is copolymerizable with (a) and (b);and wherein the a/b molar ratio is between 50/50 and 10/90. Preferably, $R_1$ represents hydrogen,
$R_2$ represents methyl,
$R_3$ represents methyl,
$R_4$ represents hydrogen, and
m and n are equal to 1.

The ion $X^-$ is advantageously chosen from halogen, sulfate, hydrogen sulfate, phosphate, citrate, formate and acetate.

The monomer (a) gives the copolymer properties of interaction with the surface to be treated, in particular allowing anchoring of the copolymer to this surface.

The monomer (b) and optionally the monomer (c) give the copolymer hydrophilic properties which, after anchoring the copolymer to the surface to be treated, are transmitted to this surface.

The copolymer according to the invention advantageously has a molecular mass by weight of at least 1000, advantageously of at least 10,000, and more particularly, of between 20,000 and 1,000,000; it can be up to 20,000,000, even up to 10,000,000.

Except where otherwise indicated, when a molecular mass is mentioned, this will be the weight-average molecular mass, expressed in g/mol.

This can be determined by aqueous gel permeation chromatography (GPC) or by measuring the intrinsic viscosity in a 1N $NaNO_3$ solution at 30° C. at a given solid content.

The copolymer is preferably a random copolymer.

The monomer (a) preferably has the following structure:

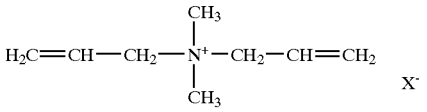

$X^-$ being as defined above.

One monomer which is particularly preferred is that of the above formula in which $X^-$ represents $Cl^-$, this monomer being known as DADMAC.

The monomers (b) are advantageously water-soluble $C_3$–$C_8$ carboxylic, sulfonic, sulfuric, phosphonic or phosphoric acids containing monoethylenic unsaturation, anhydrides thereof and water-soluble salts thereof.

Among the preferred monomers (b) which may be mentioned are acrylic acid, methacrylic acid, α-ethacrylic acid, β,β-dimethacrylic acid, methylenemalonic acid, vinylacetic acid, allylacetic acid, ethylideneacetic acid, propylideneacetic acid, crotonic acid, maleic acid, fumaric acid, itaconic acid, citraconic acid, mesaconic acid, N-methacryloylalanine, N-acryloylhydroxyglycine, sulfopropyl acrylate, sulfoethyl acrylate, sulfoethyl methacrylate, sulfoethyl methacrylate, styrenesulfonic acid, vinylsulfonic acid, vinylphosphonic acid, phosphoethyl acrylate, phosphonoethyl acrylate, phosphopropyl acrylate, phosphonopropyl acrylate, phosphoethyl methacrylate, phosphonoethyl methacrylate, phosphopropyl methacrylate and phosphonopropyl methacrylate, and the ammonium and alkali metal salts of these acids.

Among the monomers (c) which may be mentioned are acrylamide, vinyl alcohol, $C_1$–$C_4$ alkyl esters of acrylic acid and of methacrylic acid, $C_1$–$C_4$ hydroxyalkyl esters of acrylic acid and of methacrylic acid, in particular ethylene glycol and propylene glycol acrylate and methacrylate, polyalkoxylated esters of acrylic acid and of methacrylic acid, in particular the polyethylene glycol and polypropylene glycol esters.

The monomer (a) content is advantageously between 5 mol % and 60 mol %, preferably 20 mol % to 50 mol %.

The monomer (b) content is advantageously between 10 mol % and 95 mol %, preferably 20 mol % to 80 mol %.

The monomer (c) content is advantageously between 0 mol % and 50 mol %, preferably 5 mol % to 30 mol %.

The a/b molar ratio is between 50/50 and 10/90.

The copolymers of the invention can be obtained according to the known techniques for preparing copolymers, in particular by radical-mediated polymerization of the ethylenically unsaturated starting monomers which are known compounds or which can readily be obtained by a person skilled in the art using conventional synthetic processes of organic chemistry.

The radical-mediated polymerization is preferably carried out in an oxygen-free environment, for example in the presence of an inert gas (helium, argon, etc.) or nitrogen. The reaction is carried out in an inert solvent, preferably methanol or ethanol, and more preferably in water.

The polymerization is initiated by adding a polymerization initiator. The initiators used are the free-radical initiators usually used in the art. Examples comprise organic peresters (t-butyl peroxypivalate, t-amyl peroxypivalate, t-butyl peroxy-α-ethylhexanoate, etc.); organic compounds of azo type, for example azobisamidinopropane hydrochloride, azobisisobutyronitrile, azobis(2,4-dimethylvaleronitrile, etc.); inorganic and organic peroxides, for example hydrogen peroxide, benzyl peroxide and butyl peroxide, etc; redox initiator systems, for example those comprising oxidizing agents, such as persulfates (in particular ammonium or alkali metal persulfates, etc.); chlorates and bromates (including inorganic or organic chlorates and/or bromates); reducing agents such as sulfites and bisulfites (including inorganic and/or organic sulfites or bisulfites); oxalic acid and ascorbic acid, as well as mixtures of two or more of these compounds.

The preferred initiators are water-soluble initiators. Sodium persulfate and azobisamidinopropane hydrochloride are particularly preferred.

As a variant, the polymerization can be initiated by irradiation with ultraviolet light. The amount of initiators used is generally an amount which may be sufficient for initiating the polymerization. The initiators are preferably present in an amount ranging from 0.001% to approximately 10% by weight relative to the total weight of the monomers, and are preferably in an amount of less than 0.5% by weight relative to the total weight of the monomers, a preferred amount being in the range from 0.005% to 0.5% by weight relative to the total weight of the monomers. The initiator is added to the polymerization mixture in a continuous or batchwise manner.

When it is desired to obtain copolymers of high molecular mass, it is desirable to add the fresh initiator during the polymerization reaction. Gradual or batchwise addition also allows a more efficient polymerization and a shorter reaction time. The polymerization is carried out under reaction conditions that are effective for polymerizing the monomers (a), the monomers (b) and optionally the monomers (c) in an oxygen-free atmosphere. The reaction is preferably carried out at a temperature ranging from about 30° C. to about 100° C. and preferably between 60° C. and 90° C. The oxygen-free atmosphere is maintained throughout the reaction, for example by maintaining a flush of nitrogen throughout the reaction.

The following copolymers are most particularly preferred:

DADMAC/acrylic acid/acrylamide copolymer;

DADMAC/maleic acid copolymer;

DADMAC/sulfonic acid copolymer;

the DADMAC/acidic monomer molar ratio being between 50/50 and 10/90, preferably between 15/85 and less than 50/50, or between 25/75 and 45/55.

The copolymers of the invention are useful for reducing or preventing soil redeposition on kitchen- and tableware cleaned in an automatic dishwashing machine.

The copolymers described above are particularly advantageous in cleaning or rinsing compositions for cleaning or rinsing kitchen- and tableware in an automatic dishwashing machine.

The composition according to the invention intended to treat hard surfaces comprises at least one copolymer as described above whose content in said composition depends on the concentration of active ingredients therein and on the nature of the composition (cleaning or rinsing composition).

The composition according to the invention also generally comprises at least one surfactant. This is advantageously an anionic and/or nonionic surfactant.

The composition according to the invention generally comprises at least one surfactant. This is advantageously a non-ionic surfactant. It can also be a cationic, amphoteric or zwitterionic surfactant.

Among the anionic surfactants which may be mentioned in particular are soaps such as salts of $C_8$–$C_{24}$ fatty acids, for example salts of fatty acids derived from coconut and from tallow; alkylbenzenesulfonates, in particular alkylbenzenesulfonates of a linear $C_8$–$C_{13}$ alkyl in which the alkyl group comprises from 10 to 16 carbon atoms, alcohol sulfates, ethoxyalted alcohol sulfates, hydroxylalkyl sulfonates; alkyl sulfates and sulfonates, in particular of $C_{12}$–$C_{16}$ alkyl, monoglyceride sulfates, and condensates of fatty acid chlorides with hydroxyalkylsulfonates.

Anionic surfactants that are advantageous are, in particular:

- alkylester sulfonates of formula R—CH($SO_3$M)—COOR', in which R represents a $C_{6-20}$, preferably $C_{10}$–$C_{16}$, alkyl radical, R' represents a $C_1$–$C_6$, preferably $C_1$–$C_3$, alkyl radical and M represents an alkali metal (sodium, potassium or lithium) cation, a substituted or unsubstituted ammonium (methyl-, dimethyl-, trimethyl-, tetramethylammonium, dimethylpiperidinium, etc.) or an alkanolamine (monoethanolamine, diethanolamine, triethanolamine, etc.) derivative. Mention may be made most particularly of methyl ester sulfonates in which the radical R is $C_{14}$–$C_{16}$;
- alkyl sulfates of formula R$OSO_3$M, in which R represents a $C_5$–$C_{24}$, preferably $C_{10}$–$C_{18}$, alkyl or hydroxyalkyl radical, M representing a hydrogen atom or a cation of the same definition as above, as well as the ethoxylenated (EO) and/or propoxylenated (PO) derivatives thereof containing on average from 0.5 to 30 and preferably from 0.5 to 10 EO and/or PO units;
- alkylamide sulfates of formula RCONHR'$OSO_3$M, in which R represents a $C_2$–$C_{22}$, preferably $C_6$–$C_{20}$, alkyl radical, R' represents a $C_2$–$C_3$ alkyl radical, M representing a hydrogen atom or a cation of the same definition as above, as well as the ethoxylenated (EO) and/or propoxylenated (PO) derivatives thereof, containing on average from 0.5 to 60 EO and/or PO units;
- salts of saturated or unsaturated $C_8$–$C_{24}$, preferably $C_{14}$–$C_{20}$, fatty acids, $C_9$–$C_{20}$ alkylbenzenesulfonates, primary or secondary $C_8$–$C_{22}$ alkylsulfonates, alkylglyceryl sulfonates, the sulfonated polycarboxylic acids described in GB-A-1 082 179, paraffin sulfonates, N-acyl N-alkyltaurates, alkylphosphates, isethionates, alkylsuccinamates, alkylsulfosuccinates, sulfosuccinate monoesters or diesters, N-acyl sarcosinates, alkylglycoside sulfates and polyethoxycarboxylates the cation being an alkali metal (sodium, potassium or lithium), a substituted or unsubstituted ammonium residue (methyl-, dimethyl-, trimethyl- or tetramethylammonium, dimethylpiperidinium, etc.) or an alkanolamine (monoethanolamine, diethanolamine, triethanolamine, etc.) derivative;
- alkyl or alkylaryl phosphate esters such as the products Rhodafac RA600, Rhodafac PA15 or Rhodafac PA23 sold by the company Rhodia.

Among the non-ionic surfactants which may be mentioned in particular are alkylene oxide condensates, in particular condensates of ethylene oxide with alcohols, polyols, alkylphenols, fatty acid esters, fatty acid amides and fatty amines; amine oxides, sugar derivatives such as alkylpolyglycosides or fatty acid esters of sugars, in particular sucrose monopalmitate; long-chain tertiary phosphine oxides; dialkyl sulfoxides; block copolymers of polyoxyethylene and of polyoxypropylene; alkoxylated sorbitan esters; fatty esters of sorbitan, poly(ethylene oxides) and fatty acid amides modified so as to give them a hydrophobic nature (for example fatty acid mono- and diethanolamides containing from 10 to 18 carbon atoms).

Mention may be made most particularly of

- polyoxyalkylenated (polyethoxyethylenated, polyoxypropylenated or polyoxybutylenated) alkyl phenols in which the alkyl substituent is $C_6$–$C_{12}$ and containing from 5 to 25 oxyalkylene units; by way of example, mention may be made of Triton X-45, X-114, X-100 or X-102 sold by Rohm & Haas Co.;
- glucosamides, glucamides and glycerolamides;
- polyoxyalkylenated $C_8$–$C_{22}$ aliphatic alcohols containing from 1 to 25 oxyalkylene (oxyethylene or oxypropylene) units. By way of example, mention may be made of Tergitol 15-S-9 and Tergitol 24-L-6 NMW sold by Union Carbide Corp., Neodol 45-9, Neodol 23-65, Neodol 45-7 and Neodol 45-4 sold by Shell Chemical Co., and Rhodasurf IDO60, Rhodasurf LA90 and Rhodasurf IT070 sold by the company Rhodia;
- amine oxides such as ($C_{10}$–$C_{18}$)alkyldimethylamine oxides and ($C_8$–$C_{22}$) alkoxyethyldihydroxyethylamine oxides;
- the alkyl polyglycosides described in U.S. Pat. No. 4,565,647;
- $C_8$–$C_{20}$ fatty acid amides;
- ethoxylated fatty acids;
- ethoxylated amines.

Cationic surfactants are, in particular, alkylammonium salts of formula $$R^1R^2R^3R^4N^+X^-$$

in which

- $X^-$ represents a halide, $CH_3SO_4^-$ or $C_2H_5SO_4^-$ ion
- $R^1$ and $R^2$ are identical or different and represent a $C_1$–$C_{20}$ alkyl radical or an aryl or benzyl radical
- $R^3$ and $R^4$ are identical or different and represent a $C_1$–$C_{20}$ alkyl radical, an aryl or benzyl radical or an ethylene oxide and/or propylene oxide condensate $(CH_2CH_2O)_x$—$(CH_2CHCH_3O)_y$—H, in which x and y are from 0 to 30 and are never both zero, such as cetyltrimethylammonium bromide, Rhodaquat® TFR sold by the company Rhodia.

Examples of zwitterionic surfactants comprise aliphatic quaternary ammonium derivatives, in particular 3-(N,N-dimethyl-N-hexadecylammonio)propane 1-sulfonate and 3-(N,N-dimethyl-N-hexadecylammonio)-2-hydroxypropane 1-sulfonate.

Examples of amphoteric surfactants comprise betaines, sulfobetaines and carboxylates and sulfonates of fatty acids and of imidazole.

The following surfactants are preferred:

- alkyldimethylbetaines, alkylamidopropyldimethylbetaines, alkyldimethylsulfobetaines or alkylamidopropyldimethylsulfobetaines such as Mirataine CBS sold by the company Rhodia, and condensation products of fatty acids and of protein hydrolysates;

alkylamphoacetates or alkylamphodiacetates in which the alkyl group contains from 6 to 20 carbon atoms amphoteric derivatives of alkylpolyamines, such as Amphionic XL® sold by Rhodia and Ampholac 7T/X® and Ampholac 7C/X® sold by Berol Nobel.

Additional examples of suitable surfactants are compounds generally used as surfactants denoted in the well-known manuals "Surface Active Agents", volume I by Schwartz and Perry, and "Surface Active Agents and Detergents", volume II by Schwartz, Perry and Berch.

The proportion of surfactants in the composition is depending on the nature of the surfactant(s) and on the nature of the composition (cleaning or rinsing composition).

Advantageously, the copolymer of general formula I/surfactant weight ratio is between 1/2 and 1/100 and advantageously between 1/5 and 1/50.

In the text hereinbelow, except where otherwise indicated, the proportions are given on a weight basis.

Among the other common additives forming part of the formulation of the compositions, mention may be made of:

organic "builders" (detergent adjuvants for improving the surface properties of surfactants) such as:

organic phosphonates, such as those of the range the BRIQUEST from Rhodia®, and the Dequest® from Monsanto (in a proportion of from 0% to 2% relative to the total weight of the composition expressed as solids);

polycarboxylic acids or water-soluble salts thereof and water-soluble salts of carboxylic polymers or copolymers, such as polycarboxylate or hydroxypolycarboxylate ethers polyacetic acids or salts thereof (nitriloacetic acid, N,N-dicarboxymethyl-2-aminopentane dioic acid, ethylenediaminetetraacetic acid, diethylenetriaminepentaacetic acid, ethylenediaminetetraacetates, nitrilotriacetates such as Nervanaid NTA $Na_3$ sold by the company Rhodia, and N-(2-hydroxyethyl)nitrilodiacetates) (in a proportion of from 0% to 10% relative to the total weight of the composition expressed as solids);

salts of $(C_5–C_{20})$alkylsuccinic acids carboxylic polyacetal esters polyaspartic or polyglutamic acid salts citric acid, gluconic acid or tartaric acid or salts thereof (in a proportion of from 0% to 10% relative to the total weight of the composition expressed as solids);

inorganic "builders" (detergent adjuvants for improving the surface properties of surfactants) such as:

alkanolamine, ammonium or alkali metal polyphosphates (in a proportion of from 0% to 70% relative to the total weight of composition expressed as solids);

alkali metal pyrophosphates;

silicates (in an amount which can be up to 50% approximately relative to the total weight of said composition expressed as solids);

alkali metal or alkaline-earth metal borates, carbonates, bicarbonates and sesquicarbonates (in an amount which can be up to 50% approximately relative to the total weight of said composition expressed as solids);

cogranulates of hydrated alkali metal silicates and of alkali metal (sodium or potassium) carbonates, described in EP-A-488 868, such as Nabion 15 sold by the company Rhodia (in an amount which can be up to 50% approximately relative to the total weight of said composition expressed as solids);

(the total amount of organic and/or inorganic "builders" possibly representing up to 95% of the total weight of said composition expressed as solids);

bleaching agents such as perborates or percarbonates, optionally combined with acetylated bleaching activators such as N,N,N',N'-tetraacetylethylenediamine (TAED) or chlorinated products such as chloroisocyanurates, or chlorinated products such as alkali metal hypochlorites (in a proportion of from 0% to 30% relative to the total weight of said composition expressed as solids);

bleaching catalysts comprising a transition metal, especially complexes of iron, manganese and cobalt, such as those of the type $[Mn^{IV}_2\ (\mu\text{-}O)_3(Me_3TACN)_2](PF_6)_2$, $[Fe^{II}(MeN_4py)(MeCN)](ClO_4)_2$ or $[(Co^{III})(NH_3)_5(OAc)](OAc)_2$, which are described in U.S. Pat. Nos. 4,728,455, 5,114,606, 5,280,117, EP-A-909 809, U.S. Pat. No. 5,559,261, WO 96/23859, 96/23860 and 96/23861;

various other additives, such as agents which influence the pH of the detergent composition, especially alkalifying additives which are soluble in the washing liquor or enzymes or fragrances, dyes and agents which inhibit metal corrosion.

auxiliary cleaning agents such as copolymers of acrylic acid and of maleic anhydride or acrylic acid homopolymers (in a proportion of from 0% to 10% relative to the total weight of said composition expressed as solids);

fillers such as sodium sulfate or sodium chloride, in a proportion of from 0% to 50% relative to the total weight of said composition, expressed as solids;

various other additives, for instance agents which have an influence on the pH of the detergent composition, in particular basifying additives that are soluble in the washing medium (phosphates of alkali metals, carbonates, perborates or hydroxides) or acidifying additives that are soluble in the washing medium (carboxylic or polycarboxylic acids, alkali metal bicarbonates and sesquicarbonates, phosphoric and polyphosphoric acids, sulfonic acids, etc.); or enzymes or fragrances, dyes or metal-corrosion inhibitors.

For liquid formulations, the composition optionally comprises thickeners such as polyacrylates, polysaccharides and cellulose derivatives in an amount generally comprised between 0.1% and 30% by weight, relative to the total weight of the liquid composition.

The compositions according to the invention is diluted (in water) by the automatic washing machine in a cleaning or rinsing cycle, in a concentration generally comprised between 0.1 and 10 g/l.

The composition according to the invention is applied to the surface to be treated in an amount such that it allows, a deposition of copolymer according to the invention of from 0.0001 $g/m^2$ to 1 $g/m^2$, preferably 0.001 $g/m^2$ to 0.1 $g/m^2$ of surface to be treated.

According to one preferred embodiment of the invention, the copolymer described above is used for doing the washing up in an automatic machine, as described above. In this latter case, said copolymer can be present either in the detergent formulation used in the washing cycle, or in the rinsing liquid.

Detergent cleaning compositions for doing the washing up in automatic dishwashers advantageously comprise from 0.3% to 4% and preferably 0.5% to 3% by weight of water-soluble or water-dispersible copolymer relative to the total weight of solids in the composition.

The detergent dishwasher cleaning compositions also comprise at least one surfactant, preferably a nonionic surfactant, in an amount ranging from 0.2% to 10% and preferably from 0.5% to 5% relative to the weight of said detergent composition expressed as solids, the remainder consisting of various additives and fillers, as already mentioned above. These formulations generally comprise 30% to 95% of a builder agent chosen from silicates, phosphates and carbonates. They also comprise an oxidizing system, which is introduced to a content of between 3% and 25%.

More particularly, cleaning compositions, which may be used in step 1) of the method of the instant invention, comprise:

- from 0.3% to 4.0% by weight, relative to the total weight of solids in the composition of the water-soluble or water-dispersible copolymer
- from 0.2% to 10% by weight, relative to the total weight of solids, of a surfactant, and optionally
- up to 95%, relative to the total weight of detergent composition expressed as solids, of detergent adjuvants,
- up to 30%, relative to the total weight of said detergent composition expressed as solids, of a bleaching agent, optionally combined with a bleaching activator;
- up to 10%, relative to the total weight of said detergent composition expressed as solids, of auxiliary cleaning agents;
- up to 50%, relative to the total weight of said composition expressed as solids, of fillers such as sodium sulfate or sodium chloride;
- up to 25% of an oxidizing system;
- up to 10%, relative to the total weight of said composition expressed as solids, or of fragrances, dyes, and metal-corrosion inhibitors of various additives, and enzymes in the case of solid compositions, and
- optionally, thickeners in a quantity of between 0.1 and 30% relative to the total weight of the liquid composition.

Formulations for rinsing washing-up crockery in an automatic dishwasher advantageously comprise from 0.02% to 10% and preferably from 0.1% to 5% by weight of copolymer relative to the total weight of the composition.

They also comprise from 0.5% to 20% and preferably from 0.5% to 15% by weight, relative to the total weight of said composition, of a surfactant, preferably a nonionic surfactant or a mixture of nonionic and anionic surfactant.

Among the preferred nonionic surfactants which may be mentioned are surfactants such as polyoxyethylenated $C_6$–$C_{12}$ alkoylphenols, polyoxyethylenated and/or polyoxypropylenated $C_8$–$C_{22}$ aliphatic alcohols, ethylene oxide/propylene oxide block copolymers, optionally polyoxyethylenated carboxylic amides, etc.

They also comprise from 0% to 10% and preferably from 0.5% to 5% by weight, relative to the total weight of the composition, of a calcium-sequestering organic acid, preferably citric acid.

They can also comprise an auxiliary agent such as a copolymer of acrylic acid and of maleic anhydride or acrylic acid homopolymers, in a proportion of from 0% to 15% and preferably from 0.5% to 10% by weight relative to the total weight of said composition.

For example, the composition can contain organic or inorganic detergent adjuvants ("builders") as mentioned above.

The detergent adjuvant is generally used in an amount of between 0.1% and 25% by weight relative to the total weight of the composition.

More particularly, rinsing compositions, which may be used in step 1) of the method of the instant invention, comprise:

- from 0.02% to 10% of water-soluble or water-dispersible copolymer relative to the total weight of the composition;
- from 0.5% to 20%, relative to the total weight of said composition, of a nonionic surfactant or a mixture of nonionic and anionic surfactants;
- from 0% to 10%, relative to the total weight of solids, of a calcium-sequestering organic acid, preferably citric acid;
- from 0% to 15%, relative to the total weight of said composition expressed as solids, of an auxiliary detergent such as a copolymer of acrylic acid and of maleic anhydride or acrylic acid homopolymers.

The examples below are intended to illustrate the invention.

EXAMPLES 1 TO 3 AND COMPARATIVE EXAMPLES 4 TO 6

Preparation of Copolymers of the Invention.

Copolymers of the formula below are prepared as previously described:

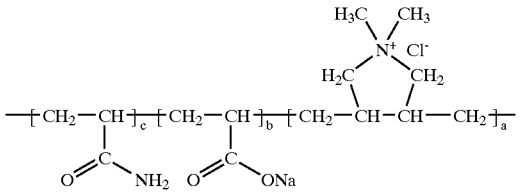

| Reference | a/b ratio | c/b/a ratio |
|---|---|---|
| Polymer 1 | 50/50 | 2/4/4 |
| Polymer 2 | 25/75 | 3/3/1 |
| Polymer 3 | 50/50 | 1/1/1 |
| Polymer 4 (comp) | 100/0 | 4/0/6 |
| Polymer 5 (comp) | 80/20 | 0/2/8 |
| Polymer 6 (comp) | 100/0 | 0/0/1 |
| Polymer 7 | 33/66 | 0/2/1 |

The copolymers of Examples 1 to 3 and of the Comparative Examples 4 to 6 are evaluated as regards their ability to give a glass plate hydrophilic properties.

Evaluation Method

A glass surface consisting of microscope slides 2.5×7.5 cm in size, precleaned with ethanol, are used, the composition of which slides is given below:

| | |
|---|---|
| Si | 21–43% by weight |
| Ca | 2.8–5.8% by weight |
| Mg | 1.6–3.4% by weight |
| Na | 6.8–14.2% by weight |
| Al | 0.3–0.7% by weight |

The test polymer is dissolved in demineralized water containing 0.5 g/l of Symperonic A7 nonionic surfactant from BASF, at a concentration of 0.5 g/l or 0.1 g/l and the pH is adjusted, by adding sodium hydroxide, to pH=9.

The solution of polymer and of surfactant is deposited on a glass slide using a centrifugal applicator with:

- deposition of the solution of polymer and of surfactant onto the glass slide;
- rotation of the glass slide at 1500 rpm for 30 seconds.

A contact angle measurement can then be carried out on the treated slide in order to obtain a so-called "without rinsing" result. The so-called "with rinsing" result requires the following additional steps:

immersing the glass slide in purified water for 15 seconds;

drying the slide by rotation with the rotary applicator, for 30 seconds at 1500 rpm.

The contact angle between the water and the treated glass is measured on a Ramé-Hart assembly and is expressed in degrees. Eight to ten measurements are taken per glass slide. Two to three glass slides are prepared for each polymer and the results thus correspond to the average of 20 to 30 measurements.

The contact angle obtained on a slide which has undergone the treatment described with an aqueous solution (demineralized water) without polymer gives a contact angle of 16°.

The values before rinsing give information regarding the hydrophilic or hydrophobic nature of the polymer. However, the most interesting data corresponds to the contact angle after rinsing, which characterizes both the hydrophilicity and the force of the polymer/glass interactions. For the application in cleaning hard surfaces, a low value of this contact angle with rinsing is desired. A polymer with a contact angle of less than 12° and most particularly less than 10° will give good performance qualities in the abovementioned applications.

The results obtained are given in the table 1 below:

TABLE 1

| Example | Contact angle 0.1 g/l before rinsing | Contact angle 0.1 g/l after rinsing | Contact angle 0.5 g/l before rinsing | Contact Angle 0.5 g/l after rinsing |
|---|---|---|---|---|
| 1 | 16.7 ± 1.0 | 17 ± 0.8 | 10.8 ± 1.0 | 6.8 ± 1.1 |
| 2 | 13 ± 0.6 | 12.8 ± 1.1 | 7.2 ± 0.8 | 6.3 ± 1.0 |
| 3 | 15 ± 0.7 | 13.5 ± 0.9 | 7.6 ± 0.8 | 10.9 ± 0.9 |
| 4 (comparative) | 20.9 ± 0.5 | 22.9 ± 1.3 | 19.7 ± 1.1 | 21.4 ± 1.3 |
| 5 (comparative) | 19.5 ± 0.8 | 20.2 ± 0.5 | 20.3 ± 0.8 | 21.4 ± 1.2 |
| 6 (comparative) | 23.3 ± 1.4 | 20.4 ± 2.4 | 24.1 ± 1.4 | 23. ± 1.2 |

These examples show that the polymers of the n give surfaces long-lasting hydrophilicity a/b ratio is less than 50/50. This is not the the comparative polymers, which have an a/b greater than 50/50.

EXAMPLES 4 TO 8

Washing Formulations for Automatic Dishwashers

Base solid formulations 4–7 are prepared from the compounds whose quantities are given in % by weight relative to the total weight of said composition expressed as solids, in the table 2 below:

TABLE 2

| Formulation example | Example 4 | Example 5 | Example 6 | Example 7 | Example 8 |
|---|---|---|---|---|---|
| Sodium tripoly-phosphate | 0 | 0 | 60 | 35 | 30 |
| Sodium carbonate | 35 | 30 | 0 | 20 | 0 |

TABLE 2-continued

| Formulation example | Example 4 | Example 5 | Example 6 | Example 7 | Example 8 |
|---|---|---|---|---|---|
| Sodium disilicate | 20 | 15 | 23 | 10 | 20 |
| Sodium citrate | 20 | 15 | 0 | 0 | 0 |
| Sodium sulfate | 0 | 20 | 0 | 19 | 0 |
| Sodium polyacrylate CP5 from BASF | 6 | 5 | 0 | 0 | 3 |
| Plurafac LF 403 | 2 | 1 | 2 | 2 | 2 |
| Bleaching system (perborate · 1 $H_2O$ + TAED**) | 12 | 10 | 10 | 10 | 0 |
| Other additives (including benzo-triazole, enzymes, fragrance) | 3 | 3 | 3 | 3 | 2 |
| Polymer 7 | 0.2 | 0.2 | 0.2 | 0.2 | 0.2 |
| Sodium hypochlorite | 0 | 0 | 0 | 0 | 0.1 |
| Water | 0 | 0 | 0 | 0 | qs 100 |

The formulation of example 8 is liquid and the quantities of compounds are given in the above table 2, in % by weight relative to the total weight of the liquid formulation. The quantity of water is the complement to 100% (qs 100).

Protocol of the Soil Antiredeposition Test

The washing formulations 4–8 are employed in a dishwasher by introducing it into the compartment in the machine that is provided for this purpose.

20 g of conventional detergent powder containing 0.1% or 0.2% of test polymer are employed in this way.

The test is carried out on 10 soda glasses disposed in a regular fashion in the machine.

40 grams of "soiling" are introduced into the dishwasher.

The soiling used is a mixture of salad cream (50%), ketchup (5%), mayonnaise (10%), milk (25%) and crème fraîche (10%).

Three successive cycles at 65° C. are carried out under identical conditions.

When dry, the glasses are evaluated (on criteria of transparency, brilliance and absence of marks) by a panel of 15 trained individuals, who award scores of between −10 and +10 on the following scale:

−10: soil deposit, white haze or soil marks much more visible than on the control −5: soil deposit, white haze or soil marks more visible than on the control 0: formulations tested without polymer (control):

white haze and soil marks clearly visible

+3: 12 to 24 soil marks, white haze

+5: 4 to 12 soil marks, slight white haze

+7: less than 4 soil marks, very slight white haze

+10: clean glass, no soil marks or white haze

The results obtained are gathered in the table 3 below:

TABLE 3

| | Example 4 | Example 5 | Example 6 | Example 7 | Example 8 |
|---|---|---|---|---|---|
| Polymer 7 Quantity (%) (Controls) | 0 | 0 | 0 | 0 | 0 |
| Glasses Evaluation | 0 | 0 | 0 | 0 | 0 |
| Polymer 7 Quantity (%) | 0.2 | 0.2 | 0.2 | 0.2 | 0.2 |
| Glasses Evaluation | 7 | 6 | 8 | 8 | 7 |

All the tests have been performed with a formulation without polymer 7. The results of table 3 shows that formulations 4 to 8 are efficient only in the presence of polymer 7.

EXAMPLES 9 TO 11

Formulations for Rinsing Washing-Up Crockery in an Automatic Dishwasher

| Formulation | Example 9 | Example 10 | Example 11 |
|---|---|---|---|
| C13-3PO-7EO nonionic surfactant (EO/PO linear fatty alcohol) | 12 | 12 | 12 |
| Citric acid | 3 | 3 | 3 |
| Polymer | Polymer 1 (2%) | Polymer 2 (2%) | Polymer 7 (2%) |
| Water | qs 100 | qs 100 | qs 100 |

What is claimed is:

1. A method of reducing or preventing soil redeposition on kitchen- and tableware cleaned in an automatic dishwashing machine, comprising the steps of:

1) providing a rinsing composition comprising from 0.2% to 10% relative to the total weight of the composition of a water-soluble or water-dispersible copolymer; and 2) contacting said kitchen- and tableware with the composition in the rinse cycle of an automatic dishwashing machine, wherein the water-soluble or water-dispersible copolymer reduces or prevents redeposition of soils on the kitchen- and tableware wherein the water-soluble or water-dispersible copolymer comprises, in the form of polymerized units:

(a) at least one monomer compound of general formula I:

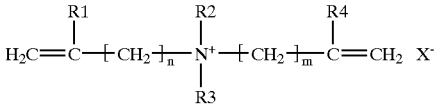

in which:

$R_1$ and $R_4$, independently of each other, represent a hydrogen atom or a linear or branched $C_1$–$C_6$ alkyl group;

$R_2$ and $R_3$, independently of each other, represent an alkyl, hydroxyalkyl or aminoalkyl group in which the alkyl group is a linear or branched $C_1$–$C_6$ chain, preferably a methyl group;

n and m are integers between 1 and 3;

X, which may be identical or different, represent counterions which are compatible with the water-soluble or water-dispersible nature of the polymer;

(b) at least one hydrophilic monomer bearing a function of acidic nature which is copolymerizable with (a) and capable of ionizing in the application medium, (c) optionally, at least one hydrophilic monomer compound containing ethylenic unsaturation and of neutral charge, bearing one or more hydrophilic groups, which is copolymerizable with (a) and (b); and wherein the a/b molar ratio is between 50/50 and 10/90.

2. The method according to claim 1, in which the monomer (a) is represented by the following formula:

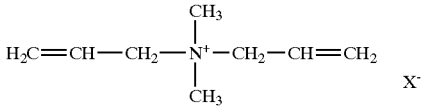

$X^-$ being chloride.

3. The method according to claim 1, wherein (b) is a $C_3$–$C_8$ carboxylic, sulfonic, sulfuric, phosphonic or phosphoric acid containing monoethylenic unsaturation.

4. The method according to claim 3,wherein the monomer (b) is acrylic acid, methacrylic acid, α-ethacrylic acid, β,β-dimethylacrylic acid, methylenemalonic acid, vinylacetic acid, allylacetic acid, ethylideneacetic acid, propylideneacetic acid, crotonic acid, maleic acid, fumaric acid, itaconic acid, citraconic acid, mesaconic acid, N-methacryloylalanine, N-acryloylhydroxyglycine, sulfopropyl acrylate, sulfoethyl acrylate, sulfoethyl methacrylate, sulfoethyl methacrylate, styrenesulfonic acid, vinylsulfonic acid, vinylphosphonic acid, phosphoethyl acrylate, phosphonoethyl acrylate, phosphopropyl acrylate, phosphonopropyl acrylate, phosphoethyl methacrylate, phosphonoethyl methacrylate, phosphopropyl methacrylate, or phosphonopropyl methacrylate.

5. The method according to claim 1, wherein the monomer (c) is acrylamide, vinyl alcohol, $C_1$–$C_4$ alkyl esters of acrylic acid and of methacrylic acid, $C_1$–$C_4$ hydroxyalkyl esters of acrylic acid and of methacrylic acid, polyalkoxylated esters of acrylic acid and of methacrylic acid, or polyethylene glycol and polypropylene glycol esters.

6. The method according to claim 1, wherein X is chloride, sulfate, hydrogen sulfate, phosphate, citrate, formate or acetate anions.

7. The method according to claim 1, wherein the water-soluble or water-dispersible copolymer is obtained by copolymerization:

of 5 mol % to 60 mol %, of the monomer (a);

of 10 mol % to 95 mol %, of the monomer (b); and of 0 mol % to 50 mol %, of the monomer (c).

8. The method according to claim 7, wherein the water-soluble or water-dispersible copolymer is obtained by copolymerization:

of 20 mol % to 50 mol %, of the monomer (a);

of 20 mol % to 80 mol % of the monomer (b); and of 5 mol % to 30 mol %, of the monomer (c).

9. The method according to claim 1, wherein the molecular mass of the copolymer is at least 1000, and not more than 20,000,000.

10. The method according to claim 1, wherein the cleaning or rinsing composition further comprises a non-ionic surfactant.

11. The method according to claim 1, wherein the composition is a rinsing composition comprising:

from 0.02% to 10% of water-soluble or water-dispersible copolymer relative to the total weight of the composition;

from 0.5% to 20%, relative to the total weight of said composition, of a nonionic surfactant or a mixture of nonionic and anionic surfactants;

from 0% to 10%, relative to the total weight of solids, of a calcium-sequestering organic acid, preferably citric acid;

from 0% to 15%, relative to the total weight of said composition expressed as solids, of an auxiliary agent, and step 2) is a rinsing step.

* * * * *